US008312901B2

(12) United States Patent
Goldbrunner

(10) Patent No.: US 8,312,901 B2
(45) Date of Patent: Nov. 20, 2012

(54) OPEN JET FILLING SYSTEM

(75) Inventor: Christian Goldbrunner, Au i.d. Hallertau (DE)

(73) Assignee: Krones AG, Neutraubling (DE)

( * ) Notice: Subject to any disclaimer, the term of this patent is extended or adjusted under 35 U.S.C. 154(b) by 645 days.

(21) Appl. No.: 12/479,897

(22) Filed: Jun. 8, 2009

(65) Prior Publication Data

US 2009/0314385 A1 Dec. 24, 2009

(30) Foreign Application Priority Data

Jun. 19, 2008 (DE) ..... 10 2008 029 208

(51) Int. Cl.
*B65B 1/04* (2006.01)
*B65B 3/04* (2006.01)

(52) U.S. Cl. ..... 141/2; 141/89; 141/90; 141/95

(58) Field of Classification Search ..... 141/89, 141/90, 82, 279, 281, 95, 372, 83, 2
See application file for complete search history.

(56) References Cited

U.S. PATENT DOCUMENTS

| | | | | |
|---|---|---|---|---|
| 5,445,194 | A * | 8/1995 | Clusserath | 141/39 |
| 5,533,552 | A * | 7/1996 | Ahlers | 141/144 |
| 5,819,817 | A * | 10/1998 | Van Nest | 141/91 |
| 6,079,460 | A * | 6/2000 | Ballan et al. | 141/145 |
| 7,571,749 | B2 * | 8/2009 | Stocchi | 141/91 |
| 2005/0034779 | A1 * | 2/2005 | Bernhard | 141/90 |

FOREIGN PATENT DOCUMENTS

| | | | |
|---|---|---|---|
| DE | 14 32 396 | A1 | 11/1968 |
| DE | 42 19 082 | A1 | 12/1993 |
| DE | 93 01 420 | | 3/1994 |
| DE | 4243001 | | 6/1994 |
| DE | 44 02 972 | A1 | 8/1995 |
| EP | 1571119 | | 9/2005 |
| FR | 2429363 | | 1/1980 |
| JP | 61160317 | A | 7/1986 |
| JP | 6364698 | A | 4/1988 |
| JP | 4128185 | A | 4/1992 |
| JP | 6312788 | A | 11/1994 |
| JP | 2002225989 | A | 8/2002 |

OTHER PUBLICATIONS

EPO Machine Translation, Description DE4243001, translated on Jan. 12, 2012.*

European Search Report for 09005600.7 dated Oct. 9, 2009.

* cited by examiner

*Primary Examiner* — Dinh Q Nguyen
*Assistant Examiner* — Jennifer Gordon
(74) *Attorney, Agent, or Firm* — Marshall, Gerstein & Borun LLP

(57) ABSTRACT

An open-jet filling system, a method of filling containers by means of such an open-jet filling system used for contactless filling a container, and a corresponding filling machine, with the open-jet filling system provided with a filling level probe. For always obtaining the same filling height in the containers and for simultaneously realizing hygienic filling, a centering unit is arranged below the open-jet filling element in a vertically movable manner such that it can be moved onto a container mouth, the filling level probe being arranged on the centering unit.

4 Claims, 3 Drawing Sheets

OPEN JET FILLING SYSTEM

CROSS-REFERENCE TO RELATED APPLICATION

The present application claims the benefit of priority of German Patent Application No. 102008029208.7, filed Jun. 19, 2008. The entire text of the priority application is incorporated herein by reference in its entirety.

FIELD OF THE DISCLOSURE

The disclosure relates to an open-jet filling system as well as to a method of filling containers by means of an open-jet filling system and a filling machine used for filling containers and comprising a plurality of circulating open-jet filling systems.

BACKGROUND

Open-jet filling systems and related methods are known from the prior art. In particular EP 1 571 119 A1 already discloses an open-jet filling system in the case of which the filling element and the container opening are spaced apart during the filling process so that there will be no contact between the filling element and the container; this has advantages from the hygienic and micro biological points of view. The open-jet filling element is provided with a filling level probe which is adapted to be introduced in the container by means of a probe actuator. In order to pinpoint the bottle mouth, the probe is implemented as an angular component. In the embodiment disclosed, the treatment of plastic containers consisting of polyethylene terephthalate (PET) is unproblematic, since these containers have dimensionally accurate container mouths and can be centered precisely below the filling element by means of neck-handling clamps.

A problem which now arises in connection with these known open-jet filling systems is that other containers cannot easily be centered sufficiently precisely with respect to the open-jet filling element. This concerns in particular plastic containers consisting of polyethylene (PE), which, as a result of the manufacturing process employed, are subject to strong variations in the three dimensions. When these containers are transported through the filling machine in a so-called base handling mode, they are supported from below by a transport table and radially from the side by format parts. Through deviations occurring in a horizontal direction that is radial to the axis of rotation of the machine, deviations between the vertical filling element axis and the vertical axis through the centre of the container mouth may occur. This has, on the one hand, the effect that the product jet will not precisely target the bottle mouth thus causing a hygienic risk at the filled bottle as well as at the surrounding machine parts. On the other hand, it may happen that the insertable probe fails to target the bottle mouth precisely, being damaged thereby, whereby an exact measurement of the filling level will no longer be possible.

This problem is normally solved by a centering means in the case of which an annular component, which is arranged below the filling element such that it extends coaxially therewith, is applied to the bottle mouth prior to the filling operation, whereby the bottle mouth will be centered exactly below the filling element.

Another problem arising is that, when base handling is used, it is, due to variations of the bottle height, impossible to realize a constant filling level when seen from the bottle mouth. Even if neck handling is used, different filling levels may be obtained due to variations of the mouth height, measured from the carrier ring to the bottle mouth, since these variations cannot be discerned by the probe actuator of the movable probe. It follows that the known system adjusts only one filling level for containers that are not dimensionally accurate, said filling level being e.g. measured from the lower edge of the filling element to the probe tip, but not from the container mouth.

SUMMARY OF THE DISCLOSURE

Starting from this prior art, it is the object of the present disclosure to provide an open-jet filling system, a corresponding method of filling containers as well as a corresponding filling machine, which allow perfect filling from the hygienic and microbiological points of view, and which simultaneously provide a possibility of measuring the filling level reliably and easily and of realizing a constant filling level when seen from the container mouth.

According to the present disclosure, the open-jet filling system is thus provided with a centering unit in addition to the open-jet filling element, which includes the open-jet valve or open jet nozzle. This centering unit is implemented as a separate component and arranged below the open-jet filling element in a vertically movable manner such that it can be moved onto a container mouth. It follows that, when it rests on the container mouth, the centering unit is able to center the container, to bring it into exact alignment with the open-jet filling element and to hold it. Since the centering unit is a separate component, which is positioned below and in spaced relationship with the open-jet filling element during the filling process, there is no contact between the open-jet filling element and the container so that microbial or bacterial contamination can be excluded. Due to the fact that the filling level probe is arranged on the centering unit, the height tolerance of the bottles can be compensated for by applying the centering unit to the respective bottle for the filling process so that a uniform empty space can be produced in the container or bottle. A constant filling level, seen from the container mouth, can be realized in this way. The phrase "onto a container mouth" is to be interpreted such that the centering unit rests directly on the container mouth, e.g. the bottle neck, or, if no neck should exist, that it rests on the container around the opening thereof.

The centering unit is implemented such that it is provided with an opening through which the container can be filled by means of an open jet. Hence the centering unit can have a very simple structural design and does not need any liquid lines, nozzles, valves etc.

The centering unit is in axial alignment with the open-jet filling element so as to guarantee that the open jet will correctly target the container opening through the centering unit.

According to an advantageous embodiment, the open-jet filling system comprises a leverage by means of which the centering unit can, preferably by means of a cam control, be moved onto the container mouth. Hence, the leverage moves the centering unit in the vertical direction to a specific position. The movement of the leverage in the vertical direction can be controlled e.g. via a cam, so that, when the open-jet filling system is moving and when the container is moving in synchronism therewith, the position of the centering unit in the vertical direction depends on the position of the horizontally moving open-jet filling system. The open-jet filling element remains preferably stationary in the vertical direction.

According to a preferred embodiment, the centering unit is implemented as a centering bell comprising an accommodating portion which widens at an oblique angle downwards and outwards for receiving therein the container mouth. Such a centering unit can easily and reliably be attached to the container opening and center and hold the container opening effectively.

It will be advantageous when the open-jet filling element is provided with guide means for the leverage. By means of this arrangement, the centering unit and the open-jet filling element can be held in correct axial alignment with one another during the filling process.

According to an advantageous embodiment, the open-jet filling element is provided with a line, in particular a line for CIP cleaning liquid. Hence, this line can, for the purpose of cleaning, be used for conducting liquid into the interior of the filling element and the centering unit as well as for discharging said liquid from said filling element and said centering unit.

For the purpose of cleaning, the filling element is additionally provided with a cleaning closure element, in particular a cleaning cap, which can be attached to the lower end of the centering unit so that the opening of said centering unit is closed at the bottom. The centering unit and the open-jet filling element can thus be cleaned effectively from inside, without any cleaning liquid escaping downwards.

In accordance with the method for filling containers by means of an open-jet filling system according to the present disclosure, the container is moved to a position below the open-jet filling element. The container can easily be moved, by means of base handling, to said position below the open-jet filling element, without any lifting movement being necessary. The centering unit is then moved onto the container mouth from above so that said centering unit will rest on said container mouth. The container can thus be brought into and also held in exact alignment with the open-jet filling system. The container can be filled by the open-jet filling element by means of an open jet through the centering unit. The filling level will then be measured via a filling level probe arranged on the centering unit and projecting into the container, and the filling process will be stopped when a specific measured filling level has been reached. Due to the fact that, as has been described hereinbefore, the length of the probe projecting into the container will always be the same, height tolerances of the containers can be compensated for during the filling process, so that a uniform filling level can be accomplished.

For the purpose of cleaning, a cleaning closure element is attached to the lower side of the centering unit. In addition, the open-jet filling element and/or the centering unit is/are moved towards one another, so that the open-jet filling element and the centering unit come into sealing contact with one another. In this way, a common interior space, which is sealed to the outside, is obtained in the open-jet filling element and in the centering unit. CIP cleaning can then be executed in said common interior space.

In the case of the method according to the present disclosure, the containers to be filled can be supplied continuously to a filling machine, where they are filled continuously and discharged continuously.

To this end, a filling machine is provided according to the present disclosure, which comprises a plurality of circulating open-jet filling systems that are arranged on a rotational system with a central liquid vessel. Making use of such a filling machine, containers can be filled continuously, and the above-mentioned advantages can be realized.

BRIEF DESCRIPTION OF THE DRAWINGS

The present disclosure will be explained in more detail hereinbelow making reference to the following figures, in which.

DETAILED DESCRIPTION OF THE PREFERRED EMBODIMENT

Figure 1:
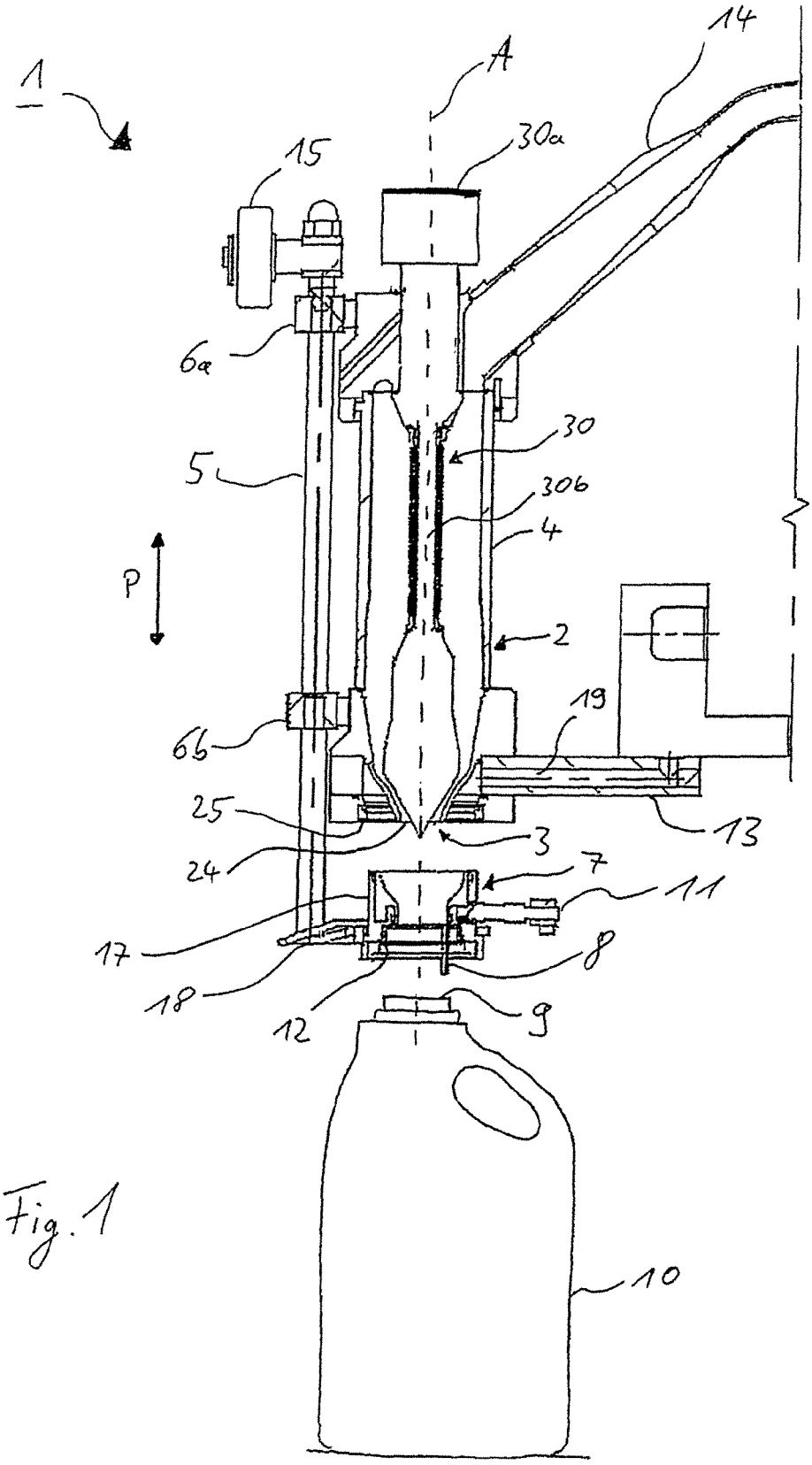
FIG. 1 shows a schematic longitudinal section through an open-jet filling system according to the present disclosure.

FIG. 1 shows an embodiment of an open-jet filling system 1 according to the present disclosure. The open-jet filling system comprises an open-jet filling element 2 for contactless filling of a container 10, e.g. a bottle, a plastic container, a can, etc. The open-jet filling element 2 is provided with a housing 4, which is sealed to the outside and in the interior of which an open-jet valve 3 is provided. The open-jet valve 3 has a conically tapering valve head and a complementary valve seat and defines here a nozzle. By means of a suitable actuator 30, the valve head can be moved up and down in the vertical direction, as indicated by arrow P, in the manner known. As can be seen in FIG. 1, the actuator can comprise a motor **30*a* and a rod 30*b* which is secured thereto. In the lower area of the housing 2, below the valve 3, an opening 24 is provided through which liquid is discharged in an open jet towards the container. The liquid to be filled into the container is supplied to the open-jet filling element 2 through the supply line 14**. The liquid is supplied e.g. from a central tank, as will be explained in detail hereinbelow.

The open-jet filling element is additionally provided with a holding arm 13 including a line 19 through which e.g. cleaning liquid for CIP cleaning can be supplied.

In addition, the open-jet filling system 1 comprises a centering unit 7, which is configured as a separate component and arranged below the open-jet filling element 2. The centering unit 7 comprises an outer housing 17 which is open at the top, i.e. in the direction of the open-jet filling element 2. This opening is provided for allowing the open jet discharged by the open-jet filling element 2 to flow through the centering unit 7. In the lower area, the centering unit 7 is provided with an accommodating portion 12 which is adapted to be brought into contact with a container mouth 9. In the present embodiment, the centering unit 7 is configured as a centering bell, said annular accommodating portion 12 widening at an oblique angle downwards and outwards so that a container mouth 9 can easily be received therein and centered.

The centering unit 7 has additionally provided thereon a filling level probe 8, which projects downwards in the direction of the container 10. The filling level probe 8 may e.g. be a resistance probe, a short circuit probe or a capacitive probe or the like. The filling level probe is connected to a control which controls the valve 3. The probe 8 is arranged in an area which, when seen in the radial direction from the center axis A, lies outside of the open jet produced. The measurement-sensitive area 26 of the filling level probe is, as can especially be seen from FIG. 2, directed outwards so as to prevent an incorrect measurement result that may be caused by the open jet or splashes. The probe may, of course, also have some other kind of structural design. The measurement area may e.g. be limited to the electrode tips. As can especially be seen from FIG. 1 and 3, the centering unit 7 additionally comprises a lateral connection 11 through which the probe is connected to the machine control.

As shown by the arrow P, the centering unit 7 is arranged such that it is vertically movable so that it can be moved towards the container mouth 9 until it rests thereon. Due to the fact that the centering unit 7, i.e. the accommodating portion 12 thereof, rests on the container 10, in particular on the container mouth 9, the length of the probe 8 projecting into the container 10 will always be the same so that height tolerances of the containers can be compensated for during the filling process and so that a uniform empty space can be realized in the container 10. The movement of the centering unit in the vertical direction takes place independently of a vertical movement of the open-jet filling element.

In the present embodiment, the vertical movement of the centering unit 7 is effected through the leverage 5 with which the centering unit 7 is connected via a fastener 18. The open-jet filling element 2, however, is stationary during the movement of the centering unit 7 in the vertical direction. The open-jet filling element is only provided with a guide means 6*a*, 6*b* for the leverage 5. This arrangement has the effect that the centering unit 7 is always in correct axial (centre axis A) alignment with the open-jet filling element 3. Alternatively to said guide means 6*a*, 6*b*, the leverage 5 can also be realized by a double pipe, i.e. by two pipes which are arranged such that one extends within the other; the inner pipe is moved up and down in the direction of the arrow P and connected to the centering unit 7 so as to move it up and down. The open-jet filling element 2 is, in this case, arranged on the non-moving outer pipe such that it is stationary in the vertical direction.

For moving the leverage in the vertical direction, a cam control is preferably provided. To this end, the running wheel 15, which runs in a suitable guide means (not shown), is provided. It follows that, when e.g. the container 10 is moved synchronously with the open-jet filling system in a horizontal direction, the leverage 5 will be moved up and down via the cam control in dependence upon the position of the open-jet filling system 1, so that it will always be able to assume a correct vertical position.

It will be of advantage when a plurality of the open-jet filling systems 1 shown in FIG. 1 is provided in a filling machine for filling containers 10. To this end, the circulating open-jet filling systems 1 are arranged, e.g. via the arm 13, on a rotational system including a central liquid vessel, or on an annular vessel. This means that the containers 10 to be filled enter the filling machine e.g. in a star wheel of said filling machine and are guided in a circle synchronously with the open-jet filling systems arranged above them. At the end of the circle, the containers leave the filling machine in the manner known. This allows a continuous filling process to be executed. While the open-jet filling system is circulating, the centering unit 7 is, as has been described hereinbefore, moved via the cam control to a suitable position, depending on the position of the open-jet filling system 1.

In the following, the method according to the present disclosure will be explained in more detail making reference to FIG. 1 to 3.

First, a container 10 is moved to a position below an open-jet filling element 2. The container 10 is moved in an upright condition to the position below the open-jet filling element 2 by means of a conveying unit, without any lifting movement being necessary.

From the position shown in FIG. 1, the centering unit 7 is then moved vertically downwards onto the container mouth 9 so that the centering unit 7 will rest on said container mouth 10. The control for the movement of the centering unit 7 is designed such that height tolerances of the respective containers are taken into account and that the centering unit 7 will always be moved to position where it rests on the container mouth. The centering unit 7 is lowered onto the container mouth 9 along the control cam under the influence of the force of gravity alone, or, if necessary, with the aid of a pressure spring.

The centering unit holds the container 10 at a correctly oriented position. By opening the open-jet valve 3, the container 10 can then be filled by means of an open jet through the centering unit 7. In the course of this filling process, the open-jet filling element 2 does not come into contact with the container 10. During filling of the container, the open-jet filling element 2 is spaced apart from the centering unit 7 in the vertical direction. The filling level in the container 10 rises until it reaches the sensitive measurement area of the filling level probe 8. At a predetermined filling level, the open-jet valve 3 will then be closed.

When the filling process has been finished, the centering unit 7 can be raised by running onto the cam control and the container 10 can be moved away from below the open-jet filling system 1.

The filling process can be executed continuously, when the containers 10 are moved in a circle on a rotational system in synchronism with the open-jet filling systems.

Figure 2:
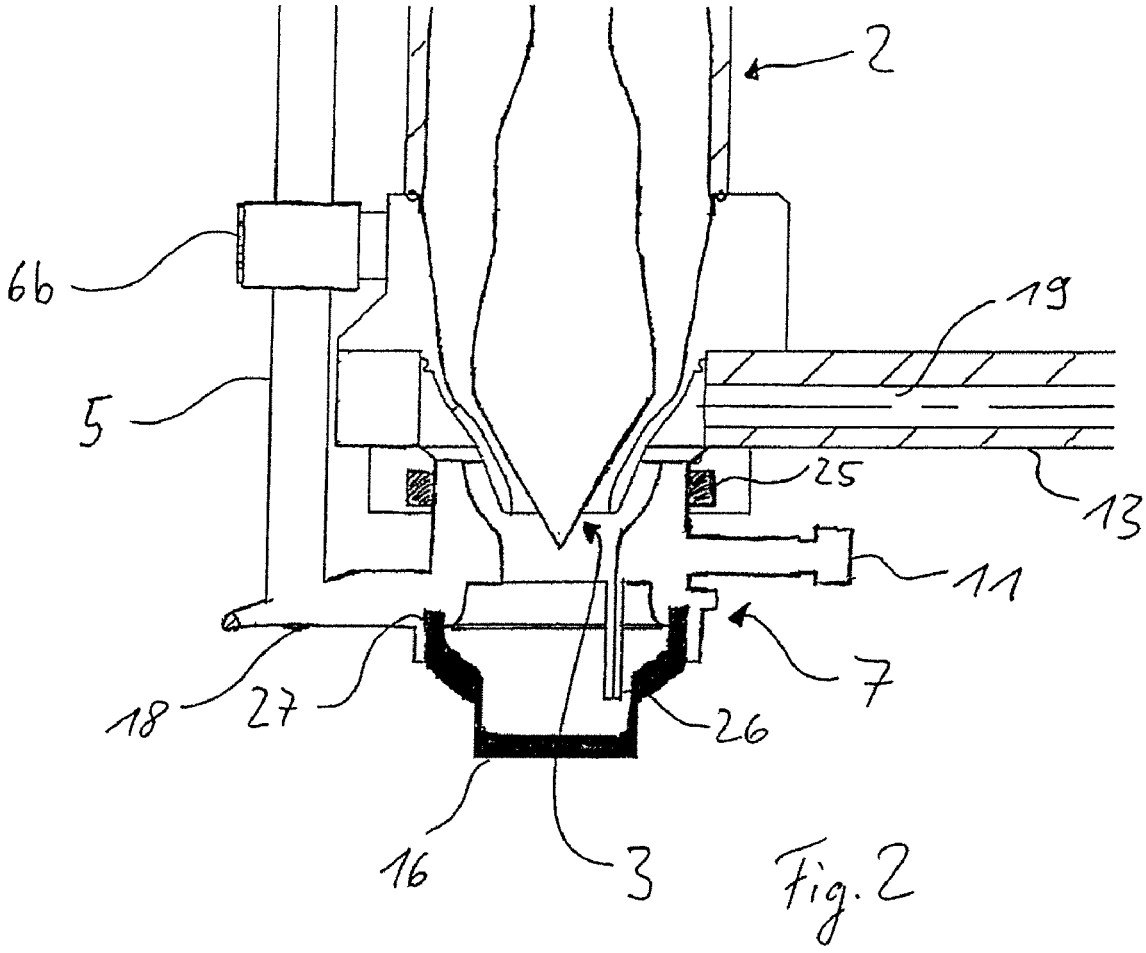
FIG. 2 shows a fragmentary section through the open-jet filling system according to the present disclosure during CIP operation.
Figure 3:
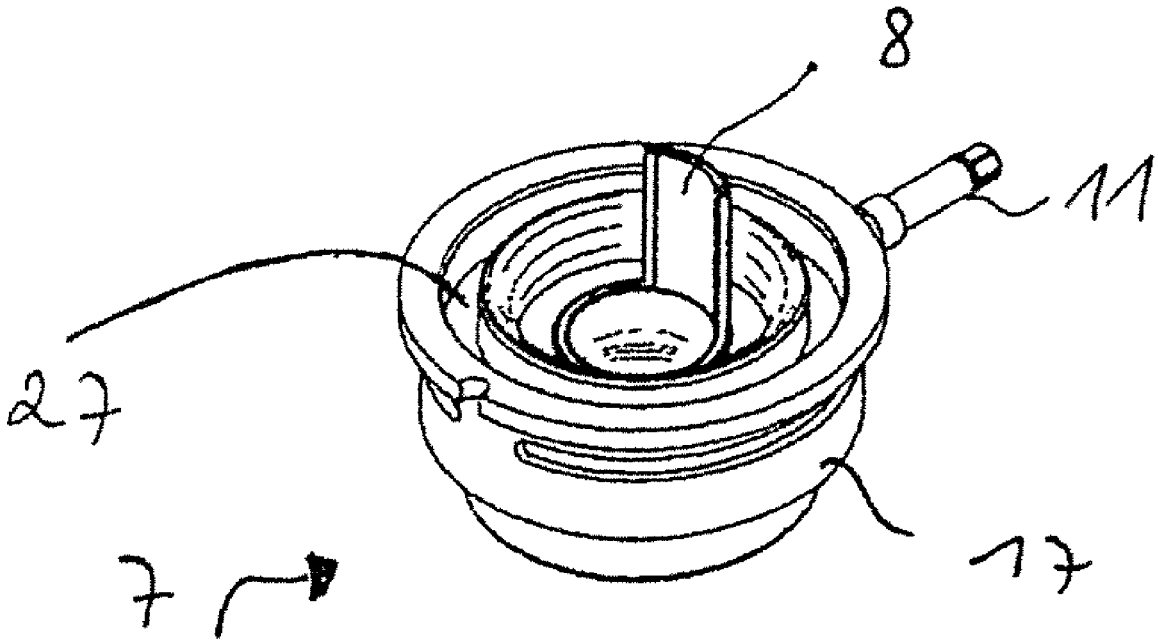
FIG. 3 shows a perspective view of a centering unit from below.

CIP cleaning of the open-jet filling system can be realized by attaching a cleaning closure element 16, in the present case a cleaning cap 16, to the lower end of the centering unit 7, as can especially be seen from FIG. 2, or by automatically introducing the same. The cleaning cap can e.g. be press-fitted into the annular groove 27, whereby the centering unit 7 will be closed at the bottom. Furthermore, the centering unit 7 can e.g. be moved onto the open-jet filling element 2 for the purpose of cleaning, so that the open-jet filling element 2 and the centering unit 7 come into sealing contact with one another. To this end, the sealing 25 is provided in the lower area of the open-jet filling element 2, as can be seen from FIG. 1. Alternatively or additionally, a corresponding sealing may also be provided in the upper area of the centering unit 7. The cap 16 can e.g. inserted into the annular groove 27 (cf. FIG. 2).

Cleaning liquid can then be supplied or discharged through line 19.

I claim:

1. A method of filling containers by means of an open-jet filling system, comprising:

moving the container to a position below an open-jet filling element, moving a vertically movable centering unit onto a container mouth of the container so that said centering unit will rest on said container mouth, filling the container by the open-jet filling element by means of an open jet through the centering unit, wherein the centering unit is formed as a separate component and is positioned below and in a spaced relationship with the open-jet filling element, measuring the filling level via a filling level probe arranged on the centering unit and projecting into the container, and stopping the filling process when a specific measured filling level has been reached.

2. A method according to claim 1, and, for the purpose of cleaning, attaching a cleaning closure element to a lower side of the centering unit.

3. A method according to claim 1, and, for the purpose of cleaning, moving one of: (a) the open-jet filling element toward the centering unit, (b) the centering unit toward the open-jet filling element, or (c) the open-jet filling element and the centering unit towards one another, so that the open-jet filling element and the centering unit come into sealing contact with one another.

4. A method according to claim 1, and, for the purpose of filling, continuously supplying the containers to a filling machine, where they are filled continuously and discharged continuously.

* * * * *